US009949041B2

(12) United States Patent
Liao et al.

(10) Patent No.: US 9,949,041 B2
(45) Date of Patent: Apr. 17, 2018

(54) HEARING ASSISTANCE DEVICE WITH BEAMFORMER OPTIMIZED USING A PRIORI SPATIAL INFORMATION

(71) Applicant: Starkey Laboratories, Inc., Eden Prairie, MN (US)

(72) Inventors: Wei-Cheng Liao, Minneapolis, MN (US); Zhi-Quan Luo, Maple Grove, MN (US); Ivo Merks, Eden Prairie, MN (US); Mingyi Hong, Ankeny, IA (US); Tao Zhang, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 14/819,875

(22) Filed: Aug. 6, 2015

(65) Prior Publication Data

US 2016/0050500 A1 Feb. 18, 2016

Related U.S. Application Data

(60) Provisional application No. 62/036,361, filed on Aug. 12, 2014.

(51) Int. Cl.
*H04R 5/00* (2006.01)
*H04R 25/00* (2006.01)
(Continued)

(52) U.S. Cl.
CPC ..... *H04R 25/505* (2013.01); *G10L 21/0208* (2013.01); *H04R 3/005* (2013.01);
(Continued)

(58) Field of Classification Search
CPC ..... H04R 25/407; H04R 25/552; H04R 2225/43; H04R 2225/41; H04R 25/505;
(Continued)

(56) References Cited

U.S. PATENT DOCUMENTS 2,235,550 A * 3/1941 Fyler ..... H03G 11/04 330/128
5,479,522 A 12/1995 Lindemann et al.
(Continued)

FOREIGN PATENT DOCUMENTS

EP 2104377 A2 9/2009
EP 2645743 A1 10/2013

OTHER PUBLICATIONS

Doclo Set al: "Reduced-Bandwidth and Distributed MWFn Based Noise Reduction Algorithms for Binaural Hea~ing Aids", IEEE Transactions on Audio, Speech and Language Processing, NEEE Service Center, New York, NY, USA, vol. 17, No. 1, Jan. 1, 2009 (Jan. 1, 2009), pp. 38-51, XP011241217, ISSN: 1558-7916, DOI: 10.1109/TASL2008.2004291.*
(Continued)

*Primary Examiner* — Lun-See Lao
(74) *Attorney, Agent, or Firm* — Schwegman Lundberg & Woessner, P.A.

(57) ABSTRACT

A hearing assistance system includes an adaptive binaural beamformer based on a multichannel Wiener filter (MWF) optimized for noise reduction and speech quality criteria using a priori spatial information. In various embodiments, the optimization problem is formulated as a quadratically constrained quadratic program (QCQP) aiming at striking an appropriate balance between these criteria. In various embodiments, the MWF executes a low-complexity iterative dual decomposition algorithm to solve the QCQP formulation.

20 Claims, 6 Drawing Sheets

(51) Int. Cl.

| | |
|---|---|
| ***H04R 3/00*** | (2006.01) |
| ***G10L 21/0208*** | (2013.01) |
| *G10L 21/0216* | (2013.01) |

(52) U.S. Cl.
CPC ..... *H04R 25/407* (2013.01); *H04R 25/552* (2013.01); *G10L 2021/02166* (2013.01); *H04R 2203/12* (2013.01); *H04R 2225/43* (2013.01); *H04R 2430/25* (2013.01); *H04R 2460/01* (2013.01)

(58) Field of Classification Search
CPC ..... H04R 2410/01; H04R 2460/01; H04R 1/1083; H04R 2430/25; H04R 25/43; H04R 3/005; H04R 2201/401; H04R 2430/03; H04R 2430/21; H04R 5/04; G10L 21/0208; G10L 2021/02165; G10L 2021/02166; G10L 17/02; G10L 17/06; G10L 17/20; G10L 2021/02082; G10L 21/0232
USPC ..... 381/23.1, 312, 328, 1, 58, 60, 356, 313, 381/314, 94.1–94.4, 92; 704/226, 233, 704/246, 270, 225
See application file for complete search history.

(56) References Cited

U.S. PATENT DOCUMENTS

| | | | | |
|---|---|---|---|---|
| 5,511,128 | A | 4/1996 | Lindemann | |
| 6,549,633 | B1 | 4/2003 | Westermann | |
| 6,983,055 | B2 | 1/2006 | Luo | |
| 7,206,421 | B1 | 4/2007 | aenzer | |
| 7,286,672 | B2 | 10/2007 | Roeck | |
| 7,657,038 | B2 * | 2/2010 | Doclo | G10L 21/0208 379/406.01 |
| 8,036,404 | B2 | 10/2011 | Kates | |
| 8,139,787 | B2 | 3/2012 | Haykin | |
| 8,290,189 | B2 | 10/2012 | Kellermann et al. | |
| 8,358,796 | B2 | 1/2013 | Puder | |
| 8,737,653 | B2 | 5/2014 | Woods | |
| 2009/0012783 | A1 * | 1/2009 | Klein | G10L 21/0208 704/226 |
| 2010/0002886 | A1 * | 1/2010 | Doclo | H04R 25/552 381/23.1 |
| 2012/0027117 | A1 * | 2/2012 | Khojastepour | H04B 7/0617 375/285 |
| 2013/0308782 | A1 | 11/2013 | Dittberner et al. | |
| 2013/0336507 | A1 | 12/2013 | Gran | |
| 2015/0230026 | A1 * | 8/2015 | Eichfeld | H04R 5/027 381/26 |

OTHER PUBLICATIONS

Spriet, Ann, et al,, "Robustness Analysis of Multichannel Wiener Filtering and Generalized Sideiobe Cancellation for Multimicrophone Noise Reduction in Hearing Aid Applications", IEEE Transactions on Speech and Audio Procesing, vol. 13, No. 4, (Jul. 2005), 487-503.*

"European Application Serial No. 15180702.1, Extended European Search Report dated Jan. 4, 2016", 9 pgs.

Capon, J., "High-Resolution Frequency-Wavenumber Spectrum Analysis", Proceedings of the IEEE, vol. 57, No. 8, (Aug. 1969), 1408-1418.

Cornelis, Bram, et al., "Analysis of localization cue preservation by multichannel wiener filtering based binaural noise reduction in hearing aids", 2006 14th European Signal Processing Conference, IEEE, (Aug. 2008), 5 pgs.

Doclo, Simon, et al., "Comparison of Reduced-Bandwidth MWF-Based Noise Reduction Algorithms for Binaural Hearing Aids", Applications of Signal Processing to Audio and Acoustics, 2007 IEEE WO Rkshop on, IEEE, PI (Oct. 2007), 223-226.

Doclo, Simon, et al., "Reduced-Bandiwdth and Distributed MWF Based Noise Reduction Algorithms for Binaural Hearing Aids", IEEE Transactions on Audio, Speech and Language Processing, IEEE Service Center, New York, NY, USA, vol. 17, No. 1, (Jan. 1, 2009).

Frost, Otis Lamont, "An Algorithm for Linearly Constrained Adaptive Array Processing", Proceedings of the IEEE, vol. 60, No. 8, (Aug. 1972), 926-935.

Gerkmann, Timo, et al., "Unbiased MMSE-Based Noise Power Estimation With Low Complexity and Low Tracking Delay", IEEE Transactions on Audio, Speech, and Language Processing, vol. 20, No. 4,, (May 2012), 1383-1393.

Griffiths, L. J., et al., "An alternative approach to linearly constrained adaptive beamforming", IEEE Trans. Antennas Propagat., 30(1), (Jan. 1982), 27-34.

Souden, Mehrez, et al., "On Optimal Frequency-Domain Multichannel Linear Filtering for Noise Reduction", IEEE Transactions on Audio, Speech, and Language Processing, vol. 20, No. 2,, (Feb. 2010), 260-276.

Spriet, Ann, et al., "A unification of adaptive multi-microphone noise reduction systems", International Workshop on Acoustic Echo and Noise Control (IWAENC 2006), Paris, France, (2006), 5 pgs.

Spriet, Ann, et al., "Robustness Analysis of Multichannel Wiener Filtering and Generalized Sidelobe Cancellation for Multimicrophone Noise Reduction in Hearing Aid Applications", IEEE Transactions on Speech and Audio Processing, vol. 13, No. 4, (Jul. 2005), 487-503.

Vorobyov, S. A, et al., "Robust adaptive beamforming using worst-case performance optimization: a solution to the signal mismatch problem", IEEE Transactions on Signal Processing, 51(2), (Feb. 2003), 313-324.

* cited by examiner

HEARING ASSISTANCE DEVICE WITH BEAMFORMER OPTIMIZED USING A PRIORI SPATIAL INFORMATION

The present application claims the benefit of priority under 35 U.S.C. § 119(e) of U.S. Provisional Patent Application Ser. No. 62/036,361, filed on Aug. 12, 2014, which application is incorporated herein by reference in its entirety.

TECHNICAL FIELD

This document relates generally to hearing assistance systems and more particularly to adaptive binaural beamformer optimized using a priori spatial information for noise reduction and speech quality.

BACKGROUND

Hearing aids are used to assist people suffering hearing loss by transmitting amplified sounds to their ear canals. Damage of outer hair cells in a patient's cochlear results loss of frequency resolution in the patient's auditory perception. As this condition develops, it becomes difficult for the patient to distinguish speech from environmental noise. Simple amplification does not address such difficulty. Thus, there is a need to help such a patient in understanding speech in a noisy environment.

SUMMARY

A hearing assistance system includes an adaptive binaural beamformer based on a multichannel Wiener filter (MWF) optimized for noise reduction and speech quality criteria using a priori spatial information. In various embodiments, the optimization problem may be formulated as a quadratically constrained quadratic program (QCQP) aiming at striking an appropriate balance between these criteria. In various embodiments, the MWF may execute a low-complexity iterative dual decomposition algorithm to solve the QCQP formulation.

In one embodiment, a hearing assistance system includes a microphone, a processing circuit, and a receiver. The microphone receives an input sound and produce a microphone signal representative of the input sound. The input sound includes a speech from a sound source. The processing circuit processes the microphone signal to produce an output signal. The processing circuit includes a multichannel Wiener filter (MWF) and approximately optimizes the MWF for noise reduction and speech quality in the output sound using a priori spatial information about the sound source. The receiver produces an output sound including the speech using the output signal.

In one embodiment, a method for operating a hearing assistance system is provided. A microphone signal is received. The microphone signal is representative of an input sound including a speech from a sound source. The microphone signal is processed to produce an output signal using a processing circuit including an MWF. The MWF is approximately optimized for noise reduction and speech quality in the output signal using a priori spatial information about the sound source.

In one embodiment, a method for processing speech in a hearing aid is provided. A microphone of the hearing aid is used to receive an input sound including the speech from a sound source and produce a microphone signal representative of the input sound. A processing circuit of the hearing aid is used to process the microphone signal to produce an output signal. A receiver of the hearing aid is used to produce an output sound including the speech based on the output signal. The processing circuit including an MWF. The MWF is approximately optimized for noise reduction and speech quality using estimated acoustic transfer functions (ATFs) for the sound source.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1:
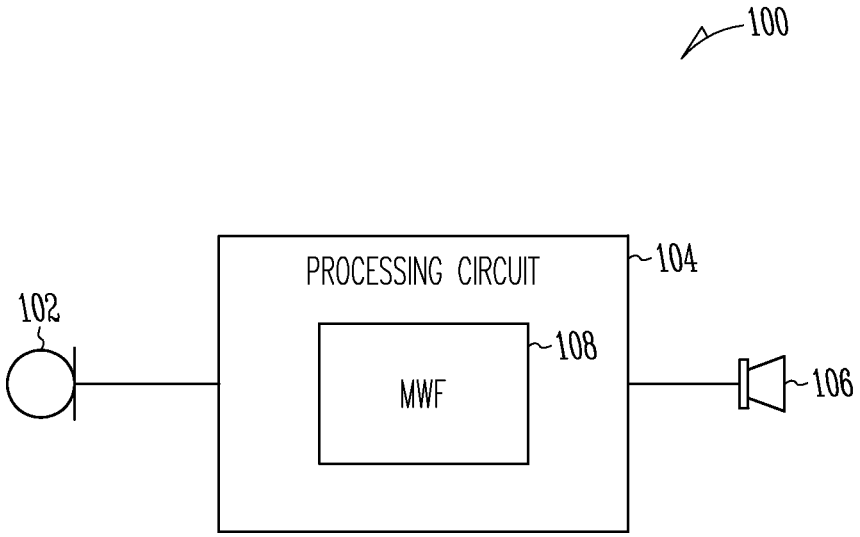
FIG. 1 is an illustration of an embodiment of a hearing assistance system including a multichannel Wiener filter (MWF).

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

This document discusses, among other things, a hearing assistance system including an adaptive beamformer that is approximately optimized using a priori spatial information for noise reduction and speech quality in binaural hearing assistance devices such as binaural hearing aids. Multichannel Wiener filter (MWF) has been proposed for adaptive binaural beamforming in hearing aids. The basic idea of using MWF for hearing aids is to obtain the minimum-mean-square-error (MMSE) estimation of a reference signal. Several existing algorithms have been proposed for applying MWF designs to binaural hearing aids. Such algorithms exploit extra degrees of freedom brought by multiple microphones. However, these MMSE filters can only be optimized when the signal correlation matrix is accurately estimated, such as in an unrealistic scenario in which signals are stationary and perfect voice activity detection (VAD) is available. Otherwise, the performance of two design criteria (or objectives), noise reduction and speech quality (intelligibility), will greatly degrade.

For example, because the mean-square-error (MSE) of the target reference signal and its estimation is minimized, these existing algorithms can significantly improve the noise reduction performance of the binaural hearing aids. However, they inevitably cause undesirable speech distortions. To mitigate the latter effect, speech distortion weighted MWF (SDW-MWF) has been proposed to balance these two design criteria using a predetermined trade-off parameter (S. Doclo, M. Moonen, T. Van den Bogaert, and J. Wouters, "Reduced-Bandwidth and Distributed MWF-Based Noise Reduction Algorithms for Binaural Hearing Aids," *IEEE Transactions on Audio, Speech, and Language Processing*, vol. 17 no. 1, pp. 38V51, 2008). In another approach, it has been suggested to explicitly enforce a speech distortion upper bound with some a priori spatial information. Examples include parameterized multichannel non-causal Wiener filter (PMWF) (M. Souden, J. Benesty, and S. Affes, "On Optimal Frequency-Domain Multichannel Linear Filtering for Noise Reduction," *IEEE Transactions on Audio, Speech, and Language Processing*, vol. 18, no. 2, pp. 260-276, 2010), minimum variance distortionless response (MVDR), and linearly constrained minimum variance (LCMV) (A. Spriet, S. Doclo, M. Moonen, and J. Wouters, "A unification of adaptive multi-microphone noise reduction systems," in *Proc. IWAENC,* 2006).

Disadvantages of such existing MWF algorithms and their variants result from their two fundamental assumptions: (1) the signal correlation matrix can be accurately estimated, and (2) a perfect VAD is available. Neither of these assumptions is practically applicable. For example, the target reference signal of human speaking and the multi-talker babble noise are usually non-stationary, and there is no known method for computing the correlation matrix. In a realistic scenario, the perfect VAD is not available, thus making the estimated correlation matrix more erroneous. The existing MWF algorithms do not provide for an optimal MMSE estimation of the reference signal, and therefore lead to performance degradation. Although the trade-off parameter for SDW-MWF can balance the performance of the two design criteria, the explicit relationship between the trade-off parameter and the design criteria is not clear. Hence, given a specific requirement for the speech distortion, proper tuning for the trade-off parameter is required. For the variants of MWF, such as PMWF, MVDR, and LCMV, the allowable speech distortion is explicitly constrained, and no parameter tuning is required. However, they usually suffer higher computation complexity, especially when there are multiple speech quality and noise reduction constraints.

The present subject matter provides hearing aids with adaptive binaural beamforming using a new MWF design that (1) alleviates the performance degradation resulting from inaccurate estimation of the signal correlation matrix, and (2) balances the performance of the two design criteria: noise reduction and speech quality. In various embodiments, a priori spatial information is incorporated into the MWF design. In various embodiments, the present subject matter also provides a general low-complexity iterative algorithm that has similar computation complexity as a conventional MWF.

In various embodiments, (approximate) knowledge of acoustic transfer functions (ATFs) for the signal sources is used to approximately optimize the MWF. This knowledge can be obtained by estimating the direction of arrivals (DOAs) of the signal sources with an assumption of the surrounded environment, e.g., anechoic room. The optimization problem is formulated as a quadratically constrained quadratic program (QCQP) aiming at striking an appropriate balance between the two design criteria: noise reduction and speech quality. A low-complexity iterative dual decomposition approach is applied to solve the QCQP formulation. For each iteration, the filter can be updated in closed-form with similar computational complexity as the conventional MWF design. The low-complexity algorithm is very efficient in practice. It often achieves a near-optimal performance within 5 to 10 iterations. More importantly, it can achieve better performance in terms of both design criteria (noise reduction and speech quality) under a reverberant room setting with imperfect spatial information. The improvement becomes much more significant when VAD errors increase.

In various embodiments, the formulated QCQP allows the number of constraints and the allowable minimum noise reduction and maximum speech distortion to be arbitrary with a unified low-complexity dual decomposition approach implementation. Therefore, the low-complexity algorithm can be used for other constrained MWF formulations as well.

Because the constraints of the formulated QCQP are independent of the correlation matrix of the signals, it is more robust to the estimation error of the correlation matrix. Therefore, numerical simulations show that the present subject matter provides for a better performance when the correlation matrix of the signals cannot be accurately estimated, such as when signals are not stationary or when imperfect VAD is used. Such benefits are achieved with similar computation complexity as the existing algorithms.

FIG. 1 is an illustration of an embodiment of a hearing assistance system 100 including an MWF. System 100 includes a microphone 102, a processing circuit 104, and a receiver (speaker) 106. In one embodiment, system 100 is implemented in a hearing aid of a pair of binaural hearing aids. Microphone 102 represents one or more microphones each receiving an input sound and produces a microphone signal being an electrical signal representing the input sound. Processing circuit 104 processes the microphone signal(s) to produce an output signal. Receiver 106 produces an output sound using the output signal. In various embodiments, the input sound may include various components such as speech and noise as well as sound from receiver 106 via an acoustic feedback path. Processing circuit 104 includes an adaptive filter to reduce the noise and acoustic feedback. In the illustrated embodiment, the adaptive filter includes an MWF 108. In various embodiments when system 100 is implemented in a hearing aid of a pair of binaural hearing aids, processing circuit 104 receives at least another microphone signal from the other hearing aid of the pair of binaural hearing aids, and MWF 108 provides adaptive binaural beamforming using microphone signals from both of the hearing aids.

In various embodiments, MWF 108 is configured to be approximately optimized to satisfy criteria specified in terms of noise reduction and speech quality in the output signal using a priori spatial information of source(s) of sound including speech. For example, MWF 108 is configured to ensure that a measure of noise reduction does not fall below a specified noise threshold while a measure of speech distortion does not exceed a specified speech threshold using the ATF from a sound source to the hearing aid. In various embodiments, processing circuit 104 is configured to approximately optimizing MWF 108 by solving a constrained optimization problem formulated as QCQP using the low-complexity iterative dual decomposition approach as discussed above.

Figure 2:
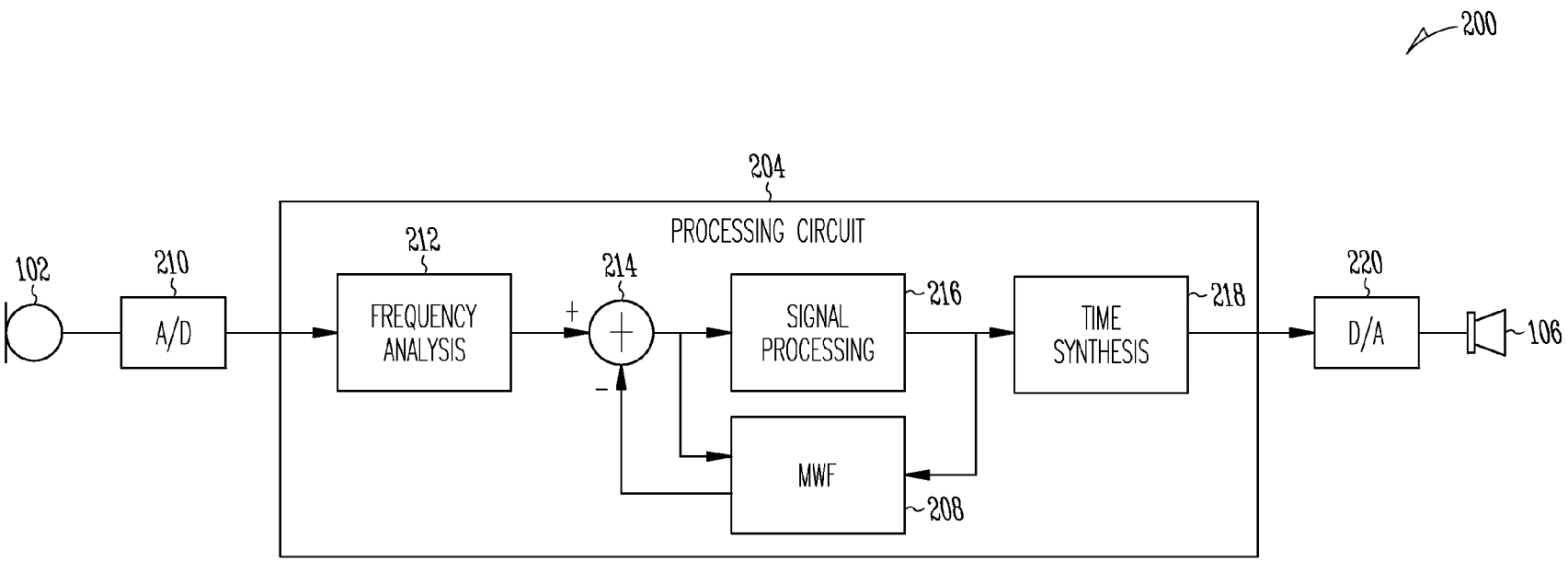
FIG. 2 is an illustration of an embodiment of a hearing assistance system with an MWF operating in frequency domain.

FIG. 2 is an illustration of an embodiment of a hearing assistance system 200 with an MWF operating in frequency domain. System 200 represents an embodiment of system 100. In one embodiment, system 200 is implemented in a hearing aid of a pair of binaural hearing aids, and the MWF provides adaptive binaural beamforming using microphone signals from both of the hearing aids.

In the illustrated embodiment, an A/D block 210 converts the microphone signal produced by microphone 102 from an analog microphone signal into a digital microphone signal. In various embodiments, A/D block 210 includes an analog-to-digital converter and may include various amplifiers or buffers to interface with microphone 102. The digital microphone signal, which represents a superposition of acoustic feedback and other sounds is processed by processing circuit 204. A D/A block 220 converts the digital output signal produced by processing circuit 204 into an analog output signal using which receiver 106 can produce an output sound. In various embodiments, D/A block 220 includes a digital-to-analog converter and may include various amplifiers or signal conditioners for conditioning the analog output signal for use by receiver 106.

Processing circuit 204 represents a simplified flow of digital signal processing from the digital microphone signal to the digital output signal. In one embodiment, the processing is implemented using a digital signal processor (DSP). In the illustrated embodiment, the digital signal processing is performed in the frequency domain. A frequency analysis module 212 converts the digital (time domain) microphone signal into frequency subband signals. A time synthesis module 218 converts the subband frequency domain output signals into a time-domain output signal. One example for such conversions includes using a fast Fourier transform (FFT) for conversion to the frequency domain and an inverse FFT (IFFT) for conversion to the time domain. Other conversion method and apparatus may be employed without departing from the scope of the present subject matter.

Signal processing module 216 includes various types of subband frequency domain signal processing that system 200 may employ. In various embodiments in which system 200 is implemented in the hearing aid, such processing may include adjustments of gain and phase for the benefit of the hearing aid user.

MWF 208 represents an embodiment of MWF 108. In various embodiments, MWF 208 is configured to provide a noise reduction of a specified minimum amount while keeping speech distortion within a specified limit. In various embodiments, MWF 208 is used in a binaural hearing aid design with frequency-domain implementation. The output of frequency analysis module 212 can be expressed as:

$$y(i,\omega)=x(i,\omega)+v(i,\omega)\in\mathbb{C}^{M\times 1},$$

where M is the total number of microphones in both of the hearing aids (the pair of binaural hearing aids), y(i, ω) is the microphone signal at the i-th time frame and the frequency tone ω, which composes of two separating parts, i.e., target signal x(i, ω) and the noise signal v(i, ω). The target signal at the hearing aids can be expressed as $$x(i,\omega)=h(\omega)s(i,\omega),$$

Where s(i, ω) is the target reference signal, and h(ω) is the ATF from the target reference signal to the hearing aids. Similarly, the noise signal at the hearing aids can be expressed as:

$$v(i,\omega)=\sum_{j\in\mathcal{N}} h_j(\omega)n_j(i,\omega),$$

where $n_j(i, \omega)$, $j\in\mathcal{N}$ is the set of noise signal sources, and $h_j(\omega)$ is the corresponding ATF from the j-th noise source to the hearing aids.

Given these notations, a constrained optimization problem for the frequency-domain MWF design for each frequency tone is formulated according to the present subject matter as:

$$\begin{aligned}&\min_{w(\omega)}\mathcal{E}\{|w^{\dagger}(\omega)v(i,\omega)|^2\}\\&\text{s.t. } \|w(\omega)^{\dagger}h(\omega,\theta)-h_r(\omega,\theta)\|^2\le\epsilon_\theta|h_r(\omega,\theta)|^2,\ \forall\,\theta\in u,\\&w(\omega)^{\dagger}h_j(\omega)h_j(\omega)^{\dagger}w(\omega)\le\epsilon_{n,j},\ \forall\,j\in\mathcal{N}.\end{aligned}$$

where $w(\omega)^{\dagger}$ is the Wiener filter coefficient vector; h(ω, θ), ∀θ∈u is the set of candidate ATFs of the target reference sources, i.e., h(ω); $h_r(\omega, \theta)$ is the ATF of the reference microphone; and $\epsilon_\theta$ and $\epsilon_{n,j}$ are respectively the predetermined parameters that control the performance of the speech distortion and the noise reduction at the hearing aids. Particularly, the objective of this formulation is to minimize the noise variance at the hearing aids. The first set of constraints aims to ensure that the speech distortion of the target reference source does not exceed the predefined threshold parameterized by $\epsilon_\theta$ for each candidate ATFs. The second set of the constraints aims to ensure that the noise reduction performance for each noise signal source is not worse than $\epsilon_{n,j}$. Since this constrained optimization problem is convex, it can be solved efficiently by existing commercial optimization toolboxes.

Figure 3:
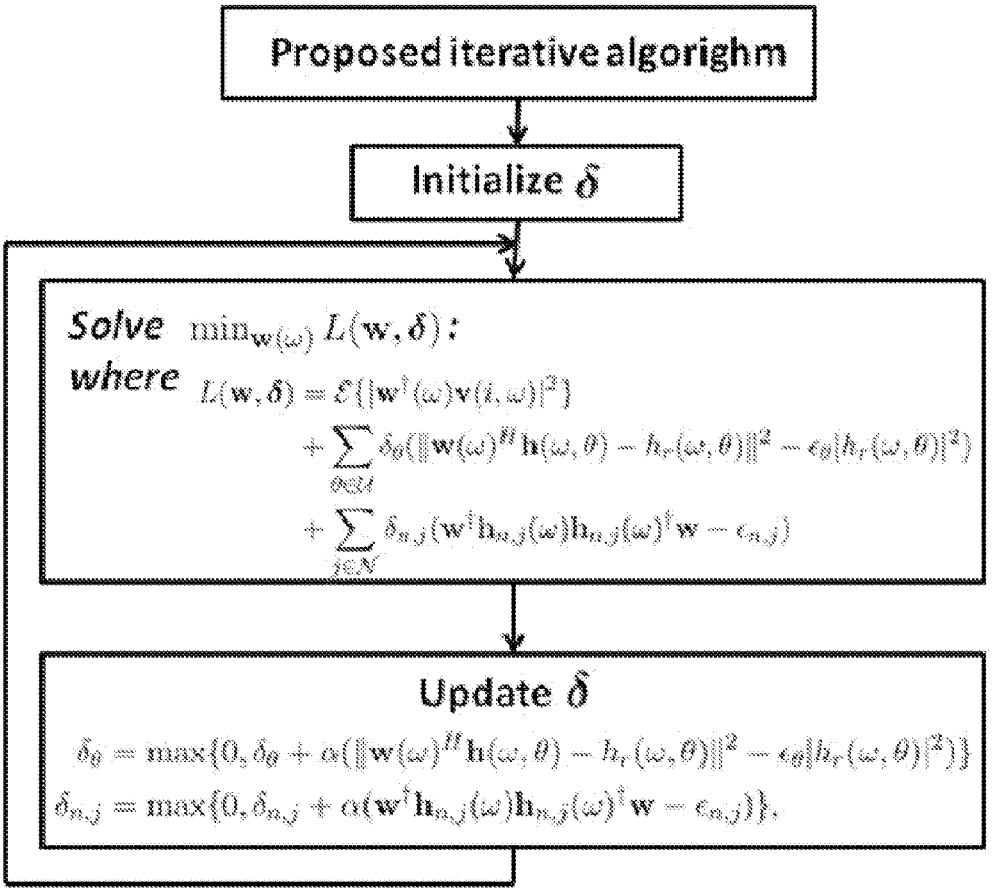
FIG. 3 is an illustration of an embodiment of a process for solving an optimization problem for the MWF of FIG. 2.

In various embodiments, processing circuit 204 is configured to solve the constrained optimization problem using a customized low-complexity dual decomposition approach. The basic idea is to dualize the constraints into the objective function with dual variables δ, so the dualized unconstrained optimization problem can be solved in closed-form as the conventional MWF algorithm. The dual variables δ can be updated in closed-form as well. FIG. 3 is an illustration of an embodiment of such a process. In FIG. 3, α is the step size that determines the convergence rate of the iterative algorithm. Examples for the step size include fixed step size or diminishing step size.

Figure 4:
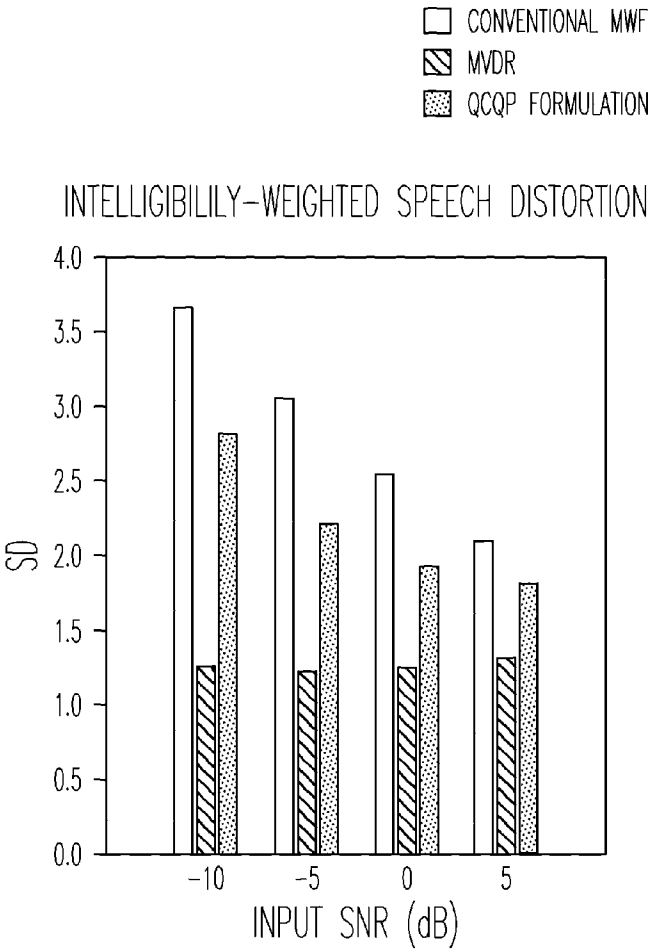
FIG. 4 includes graphs of performance data of various MWF algorithms in noise reduction and speech quality.
Figure 4:
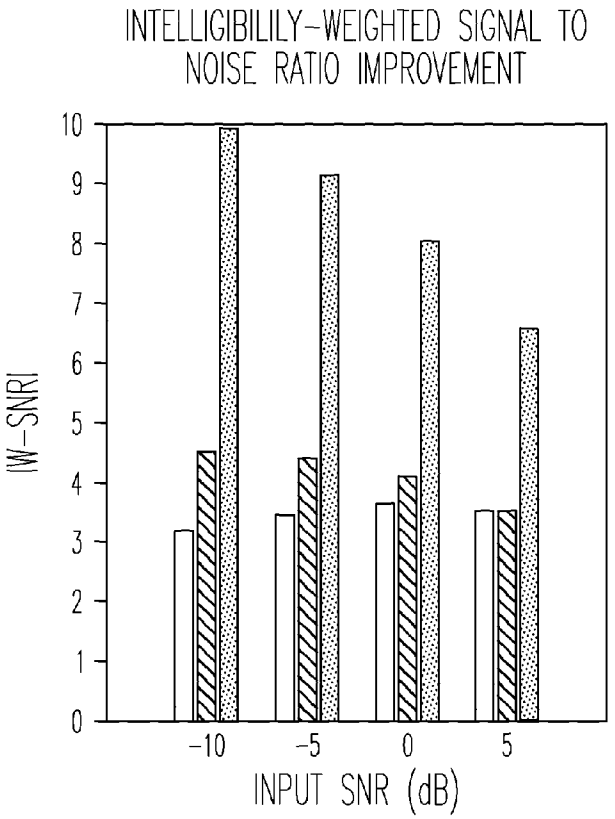

FIG. 4 includes graphs of performance data of various MWF algorithms in noise reduction and speech quality, for the purpose of illustrating the benefits of the present QCQP formulation and the efficiency of the present customized low-complexity iterative algorithm with the following environment settings: (1) 6 microphones; (2) 1 target reference source and 4 interfering noise sources; (3) perfect VAD; (4) reverberant room environment with T60=200 ms; and (5) knowledge of ATFs of the anechoic room with 5~10° DOA estimation errors. The performance of intelligibility-weighted signal to noise ratio improvement (IW-SNRI) and intelligibility-weighted speech distortion (IW-SD) are first compared (A. Spriet, M. Moonen, and J. Wouters, "Robustness analysis of multichannel Wiener filtering and generalized sidelobe cancellation for multimicrophone noise reduction in hearing aid applications," IEEE Transactions on Speech and Audio Processing, vol. 13, no. 4, pp. 487-503, 2005). From the experiment result as shown in FIG. 4, it can be observed that the QCQP formulation achieves the best performance in IW-SNRI when compared to conventional MWF and MVDR, and better performance on IW-SD when compared to MVDR.

Figure 5:
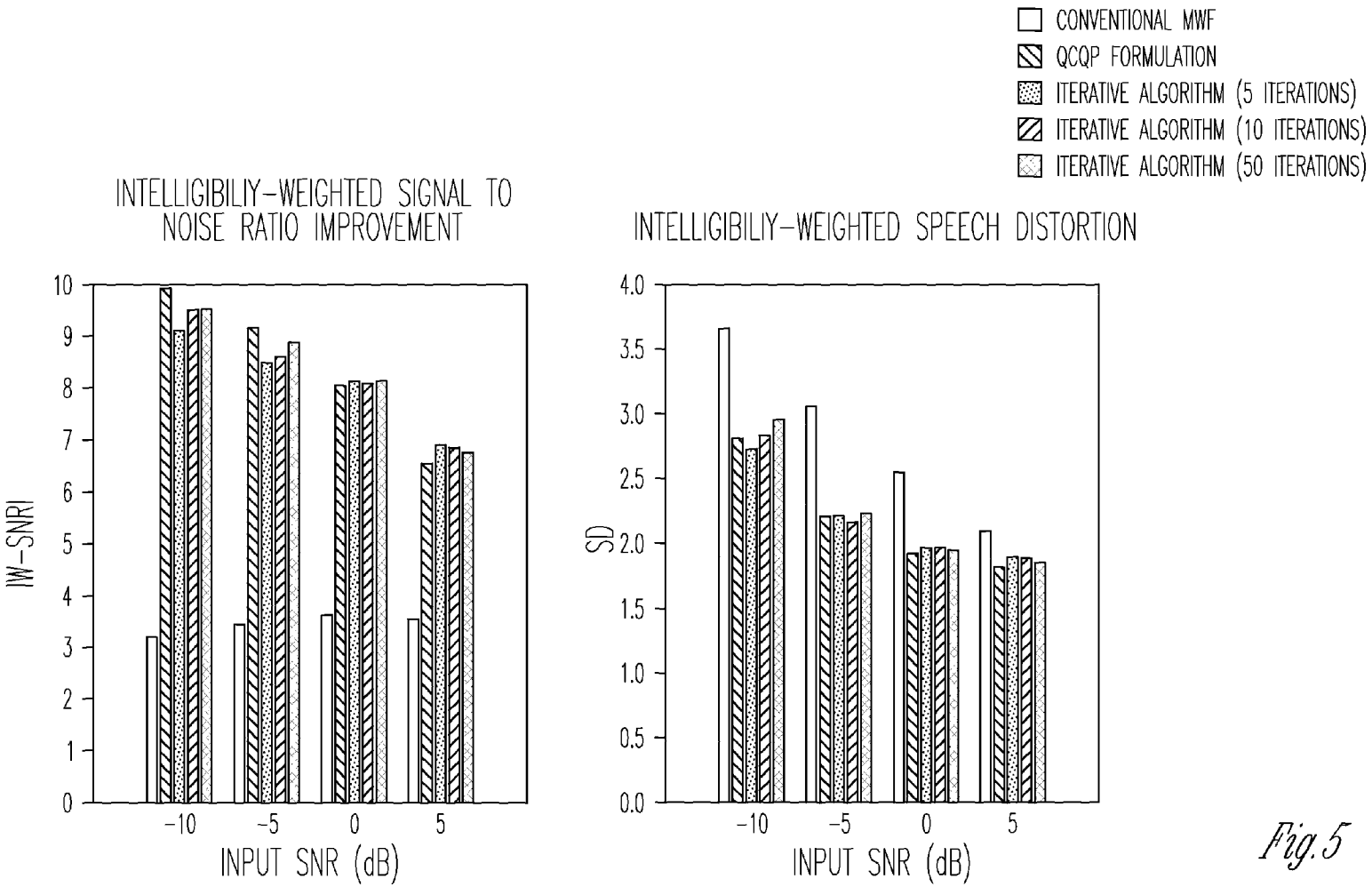
FIG. 5 includes graphs of performance data of various MWF algorithms, including the process of FIG. 3 with various numbers of iterations, in noise reduction and speech quality.

FIG. 5 includes graphs of performance data of various MWF algorithms, including the present customized low-complexity iterative algorithm with various numbers of iterations, in noise reduction and speech quality. Under the same environment settings as discussed for FIG. 4 above, instead of using commercial optimization toolbox for the QCQP formulation, the present low-complexity iterative algorithm was applied. It can be observed in FIG. 5 that near-optimal performance can be achieved within 5~10 iterations, while only marginal improvements were further achieved with up to 50 iterations.

Figure 6:
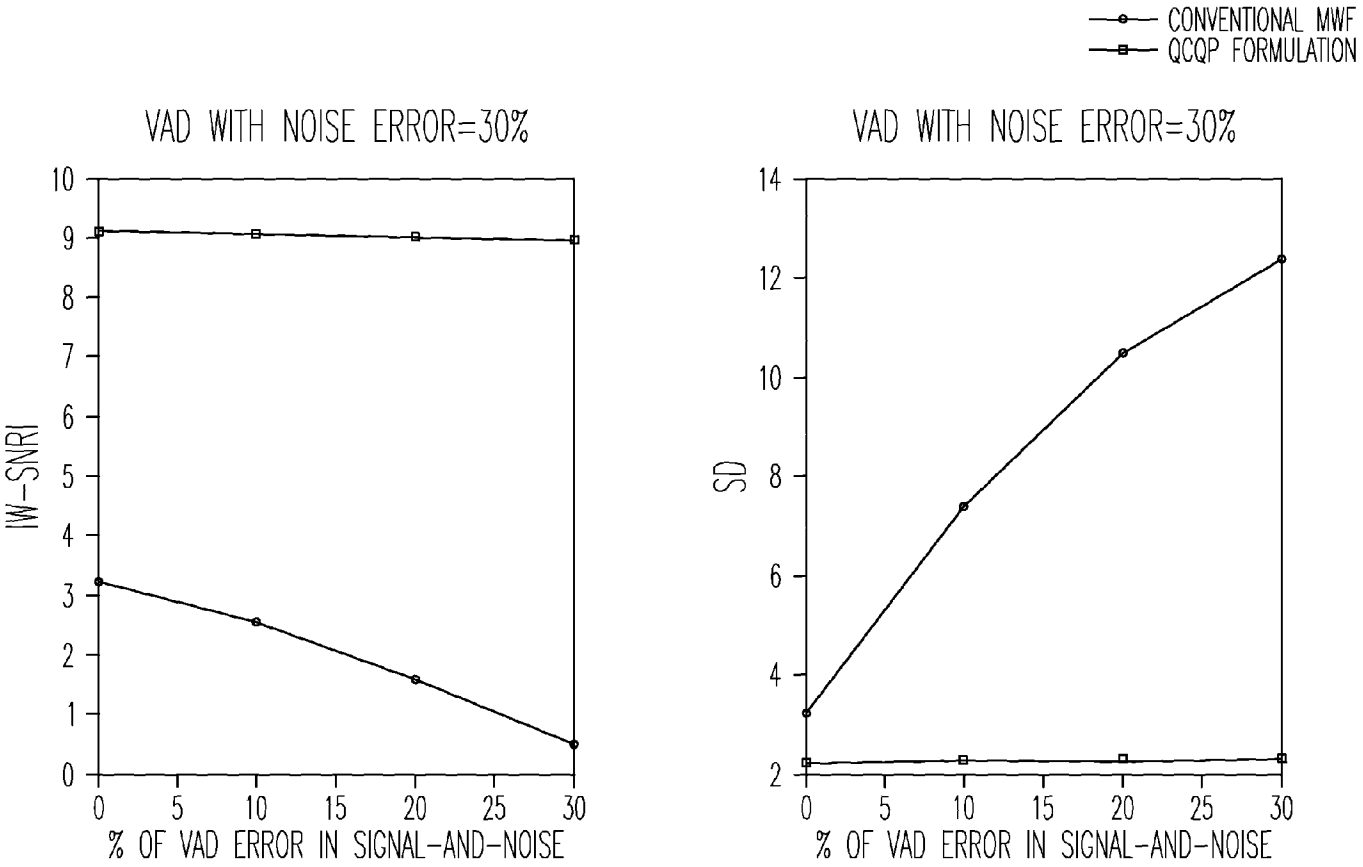
FIG. 6 includes graphs of performance data of various MWF algorithms at different levels of error in voice activity detection (VAD).

FIG. 6 includes graphs of performance data of various MWF algorithms at different levels of error in the VAD. To test the imperfect VAD, it is assumed that 30% of the noise-only frames is wrongly detected as signal-plus-noise frames, and 0%~30% of the signal-plus-noise frames is wrongly detected as noise-only frames. From the experiment result as shown in FIG. 6, the robust performance of the QCQP formulation can be observed.

In the discussion above, it is assumed that the required data transmission rate between the hearing aids can be unlimited, and a large portion of it is used for estimating the signal correlation matrices. However, for the present QCQP formulation, only the objective function depends on the correlation matrix of the noise signal, while the constraints are independent of them. This means that with a rough or inaccurate estimation of correlation matrix, an acceptable performance can still be achieved. Hence, in various embodiments, the data transmission rate between the hearing aids can be reduced to decrease the communication overhead between the hearing aids.

In various embodiments, the filter performance is further improved, and/or the computational complexity is further reduced, by properly selecting the set of possible candidate ATFs for the target source, denoted as u. From the QCQP formulation, it is clear that for each ATF in u, constraints on the maximum speech distortion are imposed. Since the computational complexity depends on the size of u, for reducing the computational complexity, u of smaller size can be chosen. On the other hand, when applying some existing algorithms to estimate the a priori signal-to-noise ratio (SNR) of the outcome for different u, (for example: T. Gerkmann, and R. C. Hendriks, "Unbiased MMSE-Based Noise Power Estimation With Low Complexity and Low Tracking Delay," IEEE Transactions on Audio, Speech, and Language Processing, vol. 20, no. 4, pp. 1383V1393, 2012), there exists a specific u that results in the maximum a priori SNR performance. That suggests the ATF of the target reference should be close to the ATFs of the u. The QCQP formulation should use this specific u in the near future where the ATF of the target reference does not vary too much. The filter performance can then be further improved with this proper chosen u.

It is understood that the hearing aid referenced in this patent application include a processor, which may be a DSP, microprocessor, microcontroller, or other digital logic. The processing of signals referenced in this application can be performed using the processor. In various embodiments, processing circuit 104 and 204 may each be implemented on such a processor. Processing may be done in the digital domain, the analog domain, or combinations thereof. Processing may be done using subband processing techniques. Processing may be done with frequency domain or time domain approaches. For simplicity, in some examples blocks used to perform frequency synthesis, frequency analysis, analog-to-digital conversion, amplification, and certain types of filtering and processing may be omitted for brevity. In various embodiments the processor is adapted to perform instructions stored in memory which may or may not be explicitly shown. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, realizations of the block diagrams, circuits, and processes set forth herein may occur without departing from the scope of the present subject matter.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing assistance system for processing speech from a sound source, comprising:

a microphone configured to receive an input sound and produce a microphone signal representative of the input sound, the input sound including the speech from the sound source;

a processing circuit configured to process the microphone signal to produce an output signal, the processing circuit including a multichannel Wiener filter (MWF) and configured to approximately optimize the multichannel Wiener filter (MWF) for noise reduction and speech quality in the output sound by minimizing a noise variance with constraints formulated using a priori spatial information about the sound source and independent of signal correlation matrix, the constraints ensuring that a measure of speech distortion is below a first threshold parameter and ensuring that a measure of noise reduction performance is at or above a second threshold parameter; and a receiver configured to produce an output sound including the speech using the output signal.

2. The hearing assistance system of claim 1, comprising a hearing aid including the microphone, the receiver, and the processing circuit.

3. The hearing assistance system of claim 2, wherein the processing circuit is configured to approximately optimize the multichannel Wiener filter (MWF) using an acoustic transfer function (ATF) from the sound source to the hearing aid.

4. The hearing assistance system of claim 3, wherein the multichannel Wiener filter NWT) is configured to provide a noise reduction of a specified minimum amount while keeping speech distortion within a specified limit.

5. The hearing assistance system of claim 4, wherein the multichannel Wiener filter (MWF) is implemented in frequency domain.

6. The hearing assistance system of claim 1, wherein the processing circuit is configured to approximately optimize the multichannel Wiener filter (MWF) by solving a constrained optimization problem formulated as a quadratically constrained quadratic program (QCQP).

7. The hearing assistance system of claim 6, wherein the processing circuit is configured to solve the constrained optimization problem using an iterative dual decomposition approach.

8. The hearing assistance system of claim 7, wherein the multichannel Wiener filter (MWF) is configured to keep a measure of the noise reduction from falling below a specified noise threshold and to keep a measure of speech distortion from exceeding a specified speech threshold.

9. A method for operating a hearing assistance system, comprising:

receiving a microphone signal representative of an input sound including a speech from a sound source;

processing the microphone signal to produce an output signal using a processing circuit including a multichannel Wiener filter (MWF); and approximately optimizing the multichannel Wiener filter (MWF) for noise reduction and speech quality in the output signal by minimizing a noise variance with sets of constraints that are independent of signal correlation matrix and formulated using a priori spatial information about the sound source to ensure that a measure of speech distortion is below a predefined speech distortion parameter and a measure of noise reduction performance is at or above a predefined noise reduction performance parameter.

10. The method of claim 9, comprising:

receiving the microphone signal from a microphone of a hearing aid;

processing the microphone signal to produce the output signal using a digital signal processor (DSP) of the hearing aid; and producing an output sound based on the output signal using a receiver of the hearing aid.

11. The method of claim 10, comprising:

receiving a further microphone signal from another microphone of another hearing aid; and processing the microphone signal and the further microphone signal to produce the output signal using the digital signal processor (DSP) of the hearing aid.

12. The method of claim 10, wherein approximately optimizing the multichannel Wiener filter (MWF) comprises approximately optimizing the multichannel Wiener filter (MWF) using a set of candidate acoustic transfer functions (ATFs) from the sound source to the hearing aid.

13. The method of claim 12, comprising formulating a constrained optimization problem using a first set of constraints aiming to ensure that a measure of speech distortion does not exceed a specified speech threshold and a second set of constraints aiming to ensure that a measure of noise reduction does not fall below a specified noise threshold, and wherein approximately optimizing the multichannel Wiener filter (MWF) comprises solving the constrained optimization problem.

14. The method of claim 13, wherein formulating the constrained optimization problem comprises formulating the constrained optimization problem as a quadratically constrained quadratic program (QCQP).

15. The method of claim 14, wherein solving the constrained optimization problem comprises solve the constrained optimization problem formulated as quadratically constrained quadratic program (QCQP) using an iterative dual decomposition approach.

16. The method of claim 12, comprising selecting the set of candidate acoustic transfer functions (ATFs) using a priori signal-to-noise ratio performance associated with outcome of using different sets of candidate acoustic transfer functions (ATFs).

17. A method for processing speech in a hearing aid, comprising:

receiving an input sound including the speech from the sound source and producing a microphone signal representative of the input sound using a microphone of the hearing aid;

processing the microphone signal to produce an output signal using a processing circuit of the hearing aid, the processing circuit including a multichannel Wiener filter (MWF);

producing an output sound including the speech based on the output signal using a receiver of the hearing aid; and approximately optimizing the multichannel Wiener filter (MWF) for noise reduction and speech quality by solving a constrained optimization problem that minimizes a noise variance with sets of constraints formulated using estimated acoustic transfer functions (ATFs) from the sound source to the hearing aid, the constraints ensuring that a measure of speech distortion is below a speech distortion parameter for the estimated ATFs and ensuring that a measure of noise reduction performance is at or above a noise reduction performance parameter.

18. The method of claim 17, wherein approximately optimizing the multichannel Wiener filter (MWF) comprises formulating a quadratically constrained quadratic program (QCQP) to minimize the noise variance.

19. The method of claim 18, wherein approximately optimizing the multichannel Wiener filter (MWF) comprises formulating the quadratically constrained quadratic program (QCQP) for balancing between the noise reduction and the speech quality.

20. The method of claim 19, wherein approximately optimizing the multichannel Wiener filter (MWF) comprises formulating the quadratically constrained quadratic program (QCQP) for keeping a measure of noise reduction from falling below a specified noise threshold while keeping a measure of speech distortion from exceeding a specified speech threshold.

* * * * *